US011033097B2

(12) United States Patent
Tarabotti

(10) Patent No.: US 11,033,097 B2
(45) Date of Patent: Jun. 15, 2021

(54) BRUSH FOR APPLYING A COSMETIC PRODUCT, IN PARTICULAR A VARNISH, ON NAILS

(71) Applicant: SORINI E MIGLIAVACCA SPA, Milan (IT)

(72) Inventor: Paolo Tarabotti, Milan (IT)

(73) Assignee: SORINI E MIGLIAVACCA SPA, Milan (IT)

( * ) Notice: Subject to any disclaimer, the term of this patent is extended or adjusted under 35 U.S.C. 154(b) by 0 days.

(21) Appl. No.: 16/653,113

(22) Filed: Oct. 15, 2019

(65) Prior Publication Data

US 2020/0121068 A1 Apr. 23, 2020

(30) Foreign Application Priority Data

Oct. 19, 2018 (IT) ..... 102018000009599

(51) Int. Cl.
*A46B 3/00* (2006.01)
*A46B 9/02* (2006.01)

(52) U.S. Cl.
CPC ..... *A46B 9/021* (2013.01); *A46B 3/005* (2013.01)

(58) Field of Classification Search
CPC ..... A46B 11/00; A46B 3/08
See application file for complete search history.

(56) References Cited

U.S. PATENT DOCUMENTS 1,587,481 A * 6/1926 Erickson ..... A46B 11/0093 15/248.1
2,227,792 A * 1/1941 Norton, Jr. ..... A46B 11/063 401/281
3,434,176 A * 3/1969 Cazet ..... A47L 13/255 15/177
5,464,275 A * 11/1995 Altemare ..... A46B 3/10 300/21
7,565,714 B2 * 7/2009 Gueret ..... A45D 34/045 15/143.1
2007/0110501 A1 * 5/2007 Gueret ..... A46B 3/16 401/129
2009/0038094 A1 * 2/2009 Kim ..... A45D 34/042 15/160
2015/0128368 A1 * 5/2015 Zagni ..... A46B 3/10 15/207.2
2016/0295992 A1 10/2016 Kim et al.

FOREIGN PATENT DOCUMENTS

EP 1050235 B1 11/2006
FR 3026624 A1 4/2016
JP H11244040 A 9/1999

OTHER PUBLICATIONS

IT Search Report dated Jun. 7, 2019 re: Application No. IT 201800009599, pp. 1-7, citing: JP H11 244040 A, FR 3 026 624 A1, US 2016/0295992 A1, US 2015/0128368 A1 and U.S. Pat. No. 5,464,275 A.

* cited by examiner

*Primary Examiner* — Michael D Jennings
(74) *Attorney, Agent, or Firm* — Cantor Colburn LLP

(57) ABSTRACT

A brush for applying a cosmetic product, in particular a varnish, on nails, includes a handle adapted to be connected at one end to a head and at an opposite end to one or more tufts of bristles for applying the product. The handle has, at the end that is adapted to be connected to the bristles, a hole which has at least one rib inside it configured for coupling with at least one tuft of bristles.

6 Claims, 5 Drawing Sheets

BRUSH FOR APPLYING A COSMETIC PRODUCT, IN PARTICULAR A VARNISH, ON NAILS

CROSS-REFERENCE TO RELATED APPLICATIONS

This application claims priority to Italian Patent Application No. 102018000009599, filed on Oct. 19, 2018, the contents of which are hereby incorporated by reference in their entirety.

TECHNICAL FIELD

The present disclosure relates to a brush for applying a cosmetic product, in particular a varnish, on nails.

More specifically, the disclosure relates to a brush for applying a cosmetic product after taking the product from a special container to which the brush is connected.

BACKGROUND

As is known, for applying cosmetic products, such as for example varnishes, on nails, brushes are used which are made up of a handle and one or more tufts of bristles which are fixed by one or more staples or strips or, optionally, by melting or overmolding, to the handle.

The handle is provided, at one end, with a head that enables it to be connected with a capsule or closure stopper, which in turn is screwed or fixed to a container of the product, so as to close it. The capsule or closure stopper enables the consumer to hold the brush. At the opposite end of the handle there are one or more seats or holes where the tuft or tufts of bristles are fixed.

There is a necessity to optimize the spreading of the varnish, combining precision of application with the possibility of applying the product on all the nails of one hand without immersing the brush multiple times in the container of the product.

In conventional brushes, this precision is obtained by way of tufts of bristles that tend to be small and easy to control, and which do not touch the cuticles of the fingers, smudging them. This ensures that the quantity of varnish applied is sufficient for a single nail, and therefore the user is not able with a single immersion of the brush to spread the product on all the nails of one hand.

If it is desired to effectively cover more than one nail with a single immersion of the brush in the product, brushes are used that are large and wide, with very thick tufts of bristles that hold large quantities of varnish. However, this is at the expense of the precision of application of the varnish.

In order to seek to cover the highest possible number of nails and at the same time maintain a certain level of precision, brushes are also known in which the cross-section of the handle is for example flat or oval, instead of circular, or is in any case elongated, and in which two or more tufts of bristles are arranged with their seats, in turn round or flattened, along the larger dimension of the handle, and in this manner the two tufts for example of bristles are arranged side-by-side with a certain spacing between them.

EP1050235B1 discloses a brush which is constituted by two tufts of bristles arranged along the greater axis of the handle, so as to form a single wide tuft at the end, in which the space at the base of the two individual tufts of bristles has the function both of allowing the consumer to see the nail below, so as to guide the application of the varnish, and of allowing a certain reserve of product. In this case too, the object of obtaining a precise application is not achieved owing to the great width of the brush at its upper end. Likewise, the reserve of product does not make it possible to apply it to more than one nail consecutively without needing to immerse the brush in the product.

Brushes can also be provided in which the seats of the two or more tufts of bristles are arranged, instead of side-by-side along the greater axis of cross-section of the handle, overlapping along the lesser axis. In such case, between the two tufts of bristles, at the base there will be a fixed distance of greater than zero. In this case, in fact, the two tufts of bristles are arranged side-by-side in the direction of the lesser axis of the cross-section of the handle.

In this case too, the tufts are fixed with the methods described previously and their application to the handle of the brush entails repeating the punching operation twice (because there are two tufts), with the outcome that the productivity of the production machine is at least slowed.

SUMMARY

The aim of the present disclosure is to provide a brush for applying a cosmetic product, in particular a varnish, on nails, in which the necessity to cover more than one nail with a single immersion of the brush in the product is combined with the requirement to obtain a precise application.

Within this aim, the present disclosure provides a brush for applying the cosmetic product, in particular a varnish on nails, that can be produced with a single punching operation that makes it possible to affix the tufts of bristles to the handle of the brush.

The present disclosure also provides a brush for applying a cosmetic product, such as a varnish, on nails, that holds a "reserve" of product that makes it possible to apply the product, loaded with a single immersion of the brush in the container of the product, to all the nails of one hand.

The present disclosure further provides a brush for applying a cosmetic product, such as a varnish, on nails, that is highly reliable, easily and practically implemented and of low cost.

This aim and these and other advantages which will become better apparent hereinafter are achieved by providing a brush for applying a cosmetic product, in particular a varnish, on nails, which comprises a handle which is adapted to be connected at one end to a head and at the opposite end to one or more tufts of bristles for applying the product, characterized in that said handle has, at the end that is adapted to be connected to said bristles, a hole which has at least one rib inside it, for coupling with at least one tuft of bristles.

BRIEF DESCRIPTION OF THE DRAWINGS

Further characteristics and advantages of the disclosure will become better apparent from the description of preferred, but not exclusive, embodiments of the brush according to the disclosure, which are illustrated by way of non-limiting example in the accompanying drawings wherein.

DETAILED DESCRIPTION OF THE DRAWINGS

Figure 1:
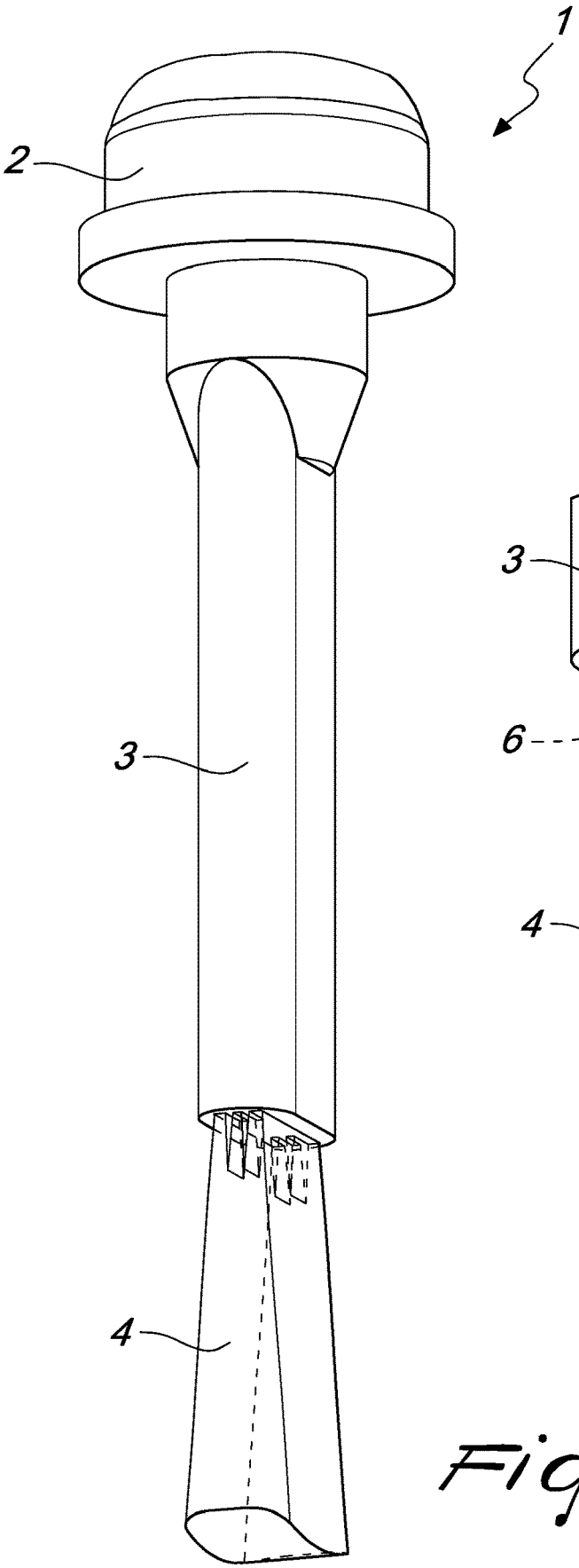
FIG. 1 is a perspective view of a first embodiment of the brush according to the disclosure.

With reference to the figures, the brush according to the disclosure, generally designated by the reference numeral 1, comprises a head 2 which is connected to a handle 3 which ends with tufts of bristles 4.

Conveniently, the head 2 is adapted to be coupled, by way of for example screwing, or the like, to a container of product, not shown in the figures.

Conveniently, the handle 3 has, at the opposite end from the end for coupling with the head 2, a contoured hole with at least one rib, in turn variously contoured, which enables the coupling of a tuft of bristles 4. The hole is illustrated in the figures and designated by the reference numeral 5, while the at least one rib is designated by the reference numeral 6. The at least one rib 6 is defined as a closed portion of the hole, which therefore constitutes a region in which the tuft of bristles 4 is not inserted into the hole. In substance, an empty region is created in the tuft of bristles 4.

Figure 2:
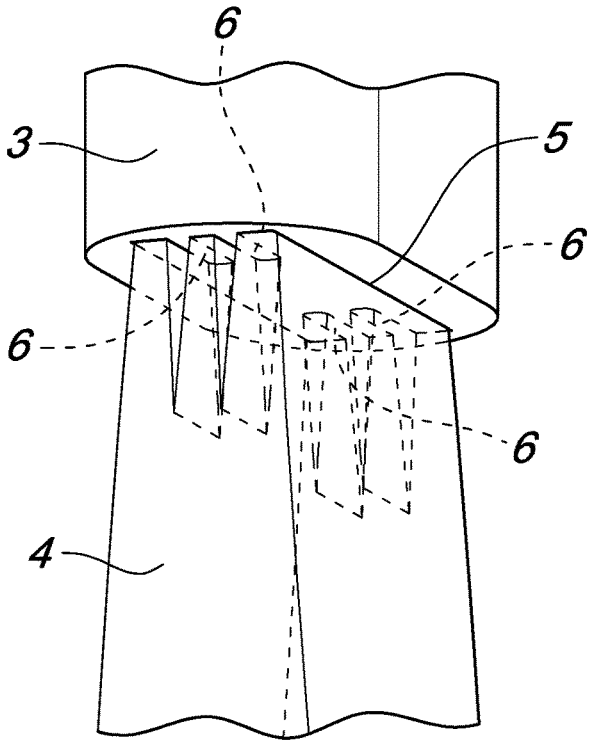
FIG. 2 is a perspective view of a detail of the brush of FIG. 1.
Figure 3:
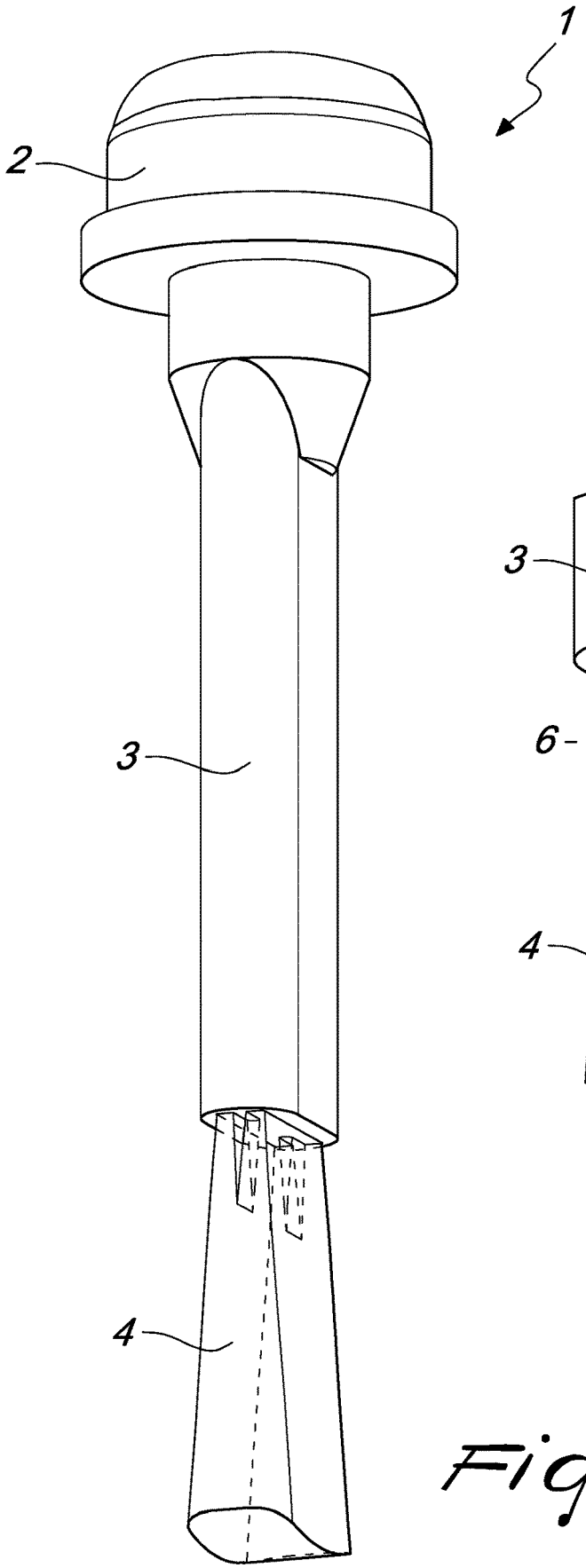
FIG. 3 is a perspective view of a second embodiment of the brush according to the present disclosure.
Figure 4:
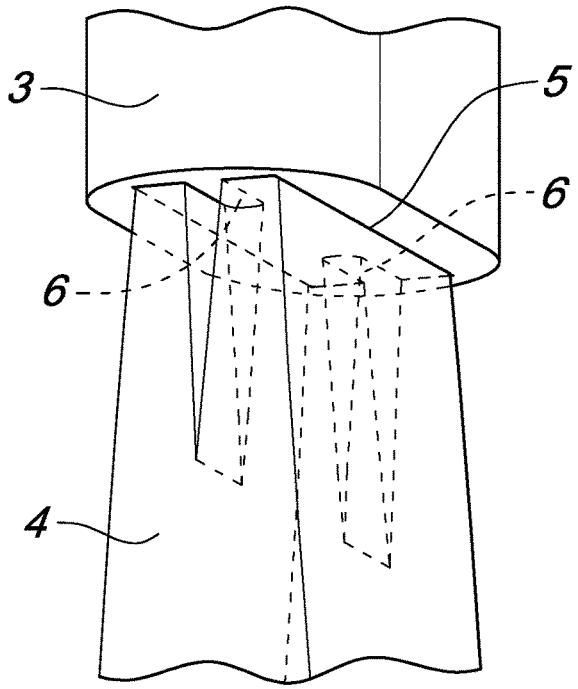
FIG. 4 is a perspective view of a detail of the brush of FIG. 3.
Figure 5:
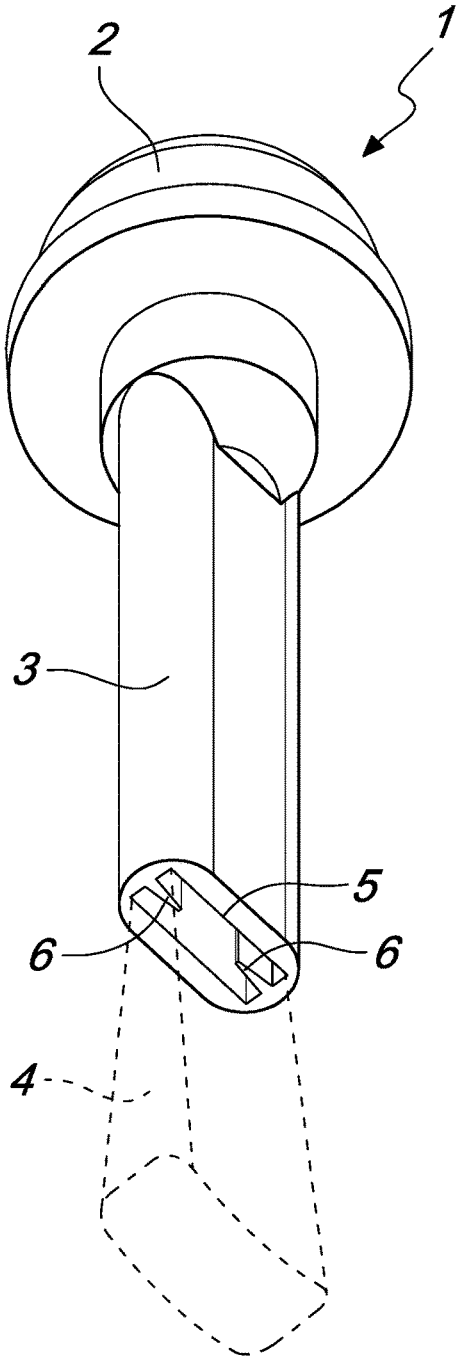
FIGS. 5 to 10 are perspective views of respective further embodiments of the brush according to the disclosure.
Figure 6:
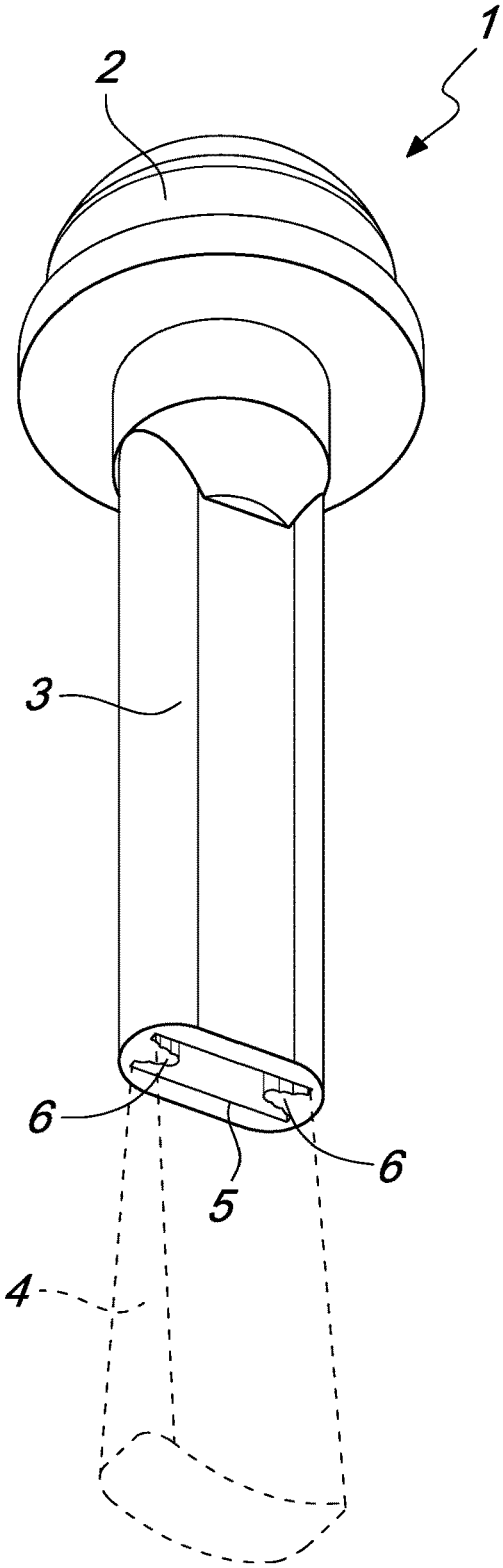
Figure 7:
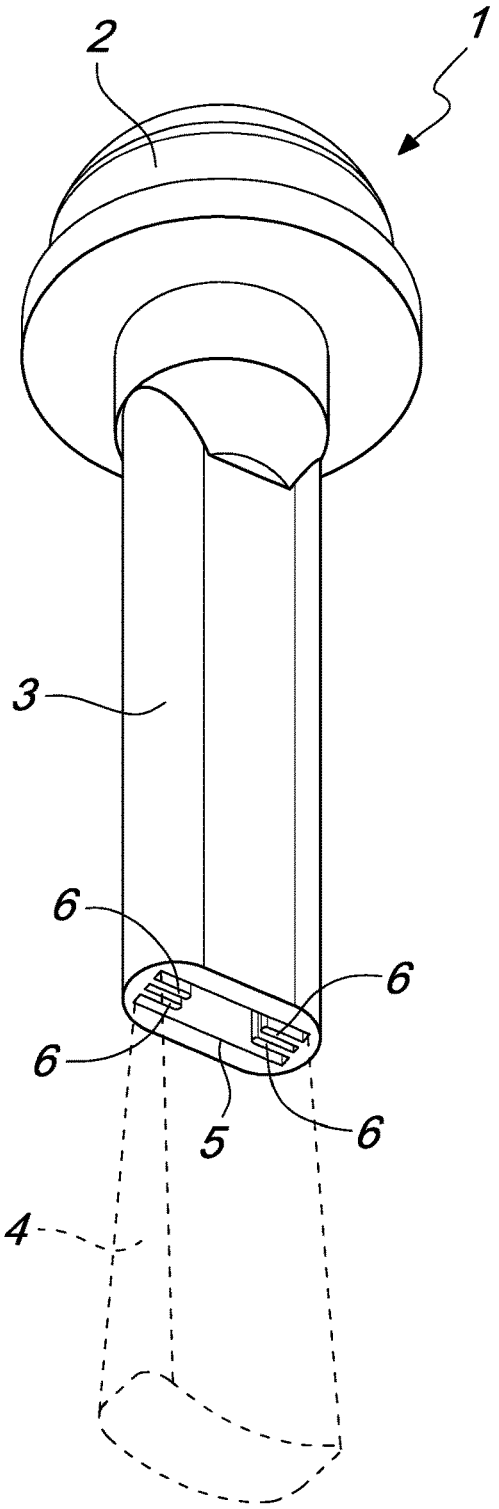
Figure 8:
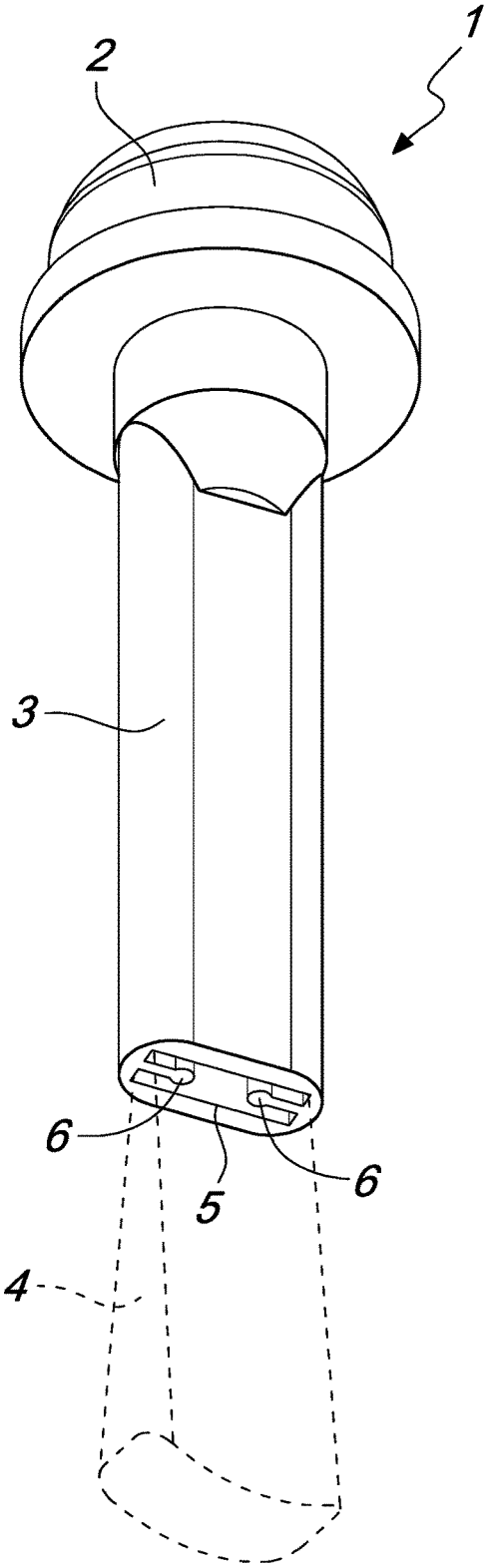
Figure 9:
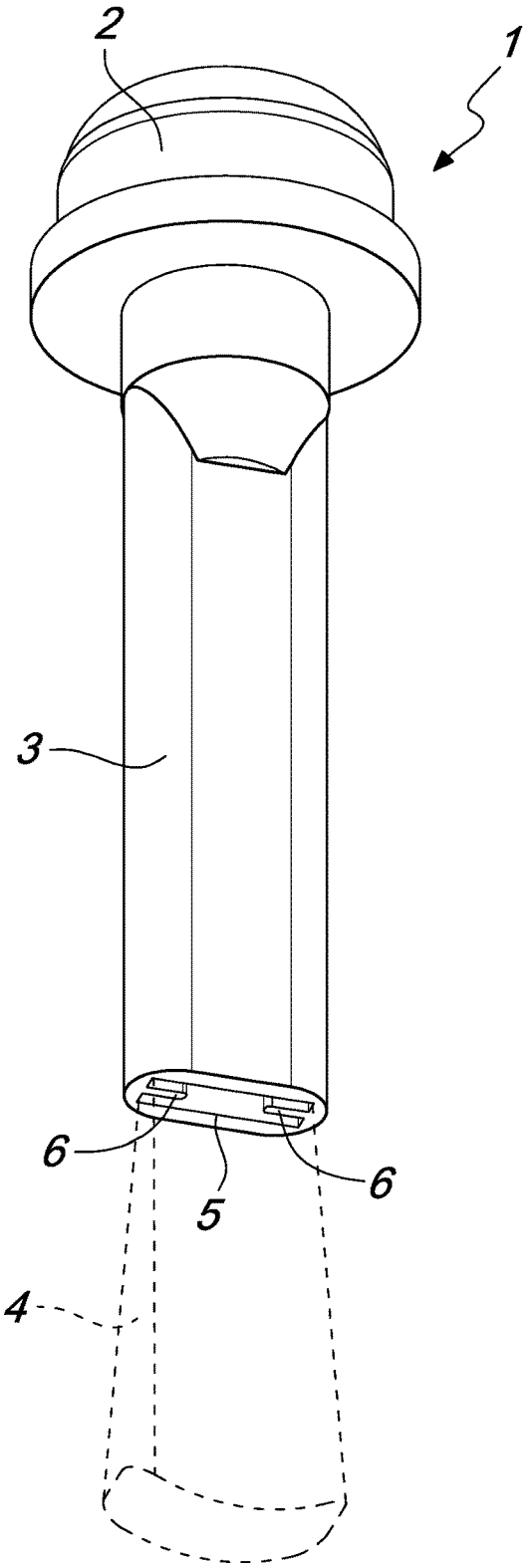
Figure 10:
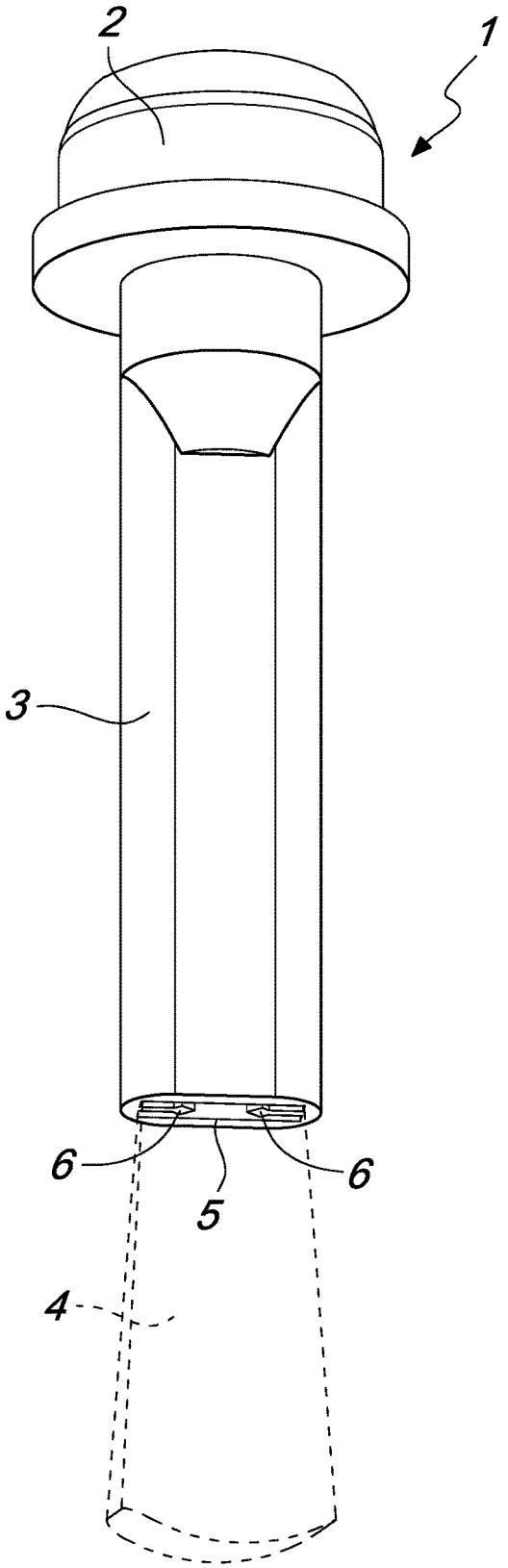

FIG. 2 illustrates an embodiment in which there are two ribs side-by-side at each side of the hole 5, while FIGS. 3 and 4 illustrate a second embodiment in which there is a single rib at each side of the hole 5.

FIGS. 5 to 10 illustrate further variants of the hole 5 in which the ribs 6 can have the shape of a cusp, a shape with a toothed and curvilinear profile at the end of the rib, or indeed a circular profile at the end of the rib, or indeed the shape of an arrowhead, again at the end of the rib.

In substance, the disclosure has a handle 3 of the brush 1 which is provided at one end with a hole 5 which in turn is provided with at least one rib 6 and preferably a pair of mutually opposite ribs.

The coupling of the tuft of bristles 4 therefore makes it possible to leave at least one empty space in the tuft of bristles 4, and this makes it possible to create a reservoir for the product.

The reservoir or reserve of product is in fact enclosed in the tuft of bristles 4 by virtue of the shape structure that the tuft of bristles 4 assumes when it is connected to the end of the handle 3 of the brush, inside the hole 5 which is contoured with at least one rib 6.

The number of tufts of bristles 4 is calculated according to the area available, and they are distributed uniformly in the hole 5, fitting in around the one or more ribs 6 that are present.

During application, the product flows from the spaces between the bristles of the tuft of bristles 4, making it possible to apply the product on more nails without the need to immerse the brush in the product anew.

The brush according to the disclosure further enables a high precision of application by virtue of the fact that the tuft of bristles 4 is of reduced dimensions and therefore enables the user to apply the product with extreme accuracy.

In practice it has been found that the brush according to the disclosure fully achieves the set aim and objects, in that it makes it possible to combine the need to be able to apply the product on more than one nail without needing to immerse the brush each time in the product contained in a container, with the need to have an extremely precise application by virtue of a brush with a tuft of bristles of small dimensions.

The brush, thus conceived, is susceptible of numerous modifications and variations, all of which are within the scope of the appended claims.

Moreover, all the details may be substituted by other, technically equivalent elements.

In practice, the materials used, as well as the contingent shapes and dimensions, may be any according to the requirements and to the state of the art.

The disclosures in Italian Patent Application No. 102018000009599 from which this application claims priority are incorporated herein by reference.

What is claimed is:

1. A brush for applying a cosmetic product, in particular a varnish, on nails, the brush comprising: a handle adapted to be connected at a first end to a head and at a second end, opposite said first end, to one or more tufts of bristles for applying the product, wherein said handle has, at the second end that is adapted to be connected to said bristles, a hole which has at least one axial rib inside it, arranged along an axis of the handle, for coupling with at least one tuft of bristles, said at least one axial rib defining an empty space within said tuft of bristles.

2. The brush according to claim 1, wherein said hole has at least one pair of mutually opposite axial ribs.

3. The brush according to claim 1, wherein said axial ribs are cusp-shaped at the second end directed toward the center of the hole.

4. The brush according to claim 1, wherein said axial ribs are shaped, at the second end adapted to be directed toward the center of said hole, with a rounded end.

5. The brush according to claim 1, wherein said axial ribs are shaped, at the second end adapted to be directed toward the center of said hole, with a circular portion.

6. The brush according to claim 1, wherein said axial ribs, at the second end adapted to be directed toward the center of said hole, have an arrowhead shape.

* * * * *